US006269606B1

(12) United States Patent
McCown

(10) Patent No.: US 6,269,606 B1
(45) Date of Patent: Aug. 7, 2001

(54) ASSEMBLY AND METHOD FOR STRAIGHTENING A GROUND RETAINING WALL

(76) Inventor: Samps H. McCown, 3360 S. 154th St. E., Wichita, KS (US) 67232

( * ) Notice: Subject to any disclaimer, the term of this patent is extended or adjusted under 35 U.S.C. 154(b) by 0 days.

(21) Appl. No.: 09/316,925

(22) Filed: May 21, 1999

(51) Int. Cl.[7] ..... E04G 21/12; E02D 37/00
(52) U.S. Cl. ..... 52/741.13; 52/223.7; 52/291
(58) Field of Search ..... 52/223.7, 291, 52/741.13; 405/284, 272

(56) References Cited

U.S. PATENT DOCUMENTS 4,189,891 * 2/1980 Jonson et al. ..... 52/741.13
4,480,945 * 11/1984 Schnabel ..... 405/262
4,824,293 * 4/1989 Brown et al. ..... 405/284
5,533,839 * 7/1996 Shimada ..... 405/284
5,839,855 * 11/1998 Anderson et al. ..... 405/262
5,921,715 * 7/1999 Rainey ..... 405/262
6,048,138 * 4/2000 Lamberson et al. ..... 405/262

* cited by examiner

*Primary Examiner*—Gregory J. Strimbu
(74) *Attorney, Agent, or Firm*—Kenneth H. Jack; Davis & Jack, LLC

(57) ABSTRACT

A method and assembly for straightening a wall, the wall having a ground retaining side, the ground retaining side of the wall retaining ground material, the ground material having a ground surface, the assembly and method including positioning a cable anchor within the ground material below the ground surface; extending a first section of a flexible cable along a path through the ground from the wall to the cable anchor; extending a second contiguous section of the cable toward the ground surface; fixedly attaching the second section of the flexible cable to a jackscrew adapted for applying a pulling force to the cable; and utilizing an arcuately curved cable guide to transmit the pulling force to the wall and to the cable anchor so that the pulling force draws the wall toward the cable anchor.

21 Claims, 6 Drawing Sheets

ASSEMBLY AND METHOD FOR STRAIGHTENING A GROUND RETAINING WALL

FIELD OF THE INVENTION

This invention relates to apparatus, assemblies, and methods for straightening poured concrete basement walls, and poured concrete earth terracing walls.

BACKGROUND OF THE INVENTION

Ground retaining walls such as the basement walls of a house or an outdoor earth terracing wall are commonly fabricated in the form of a poured slab of steel bar reinforced concrete, the slab resting on edge upon a poured concrete footing. Typically, such slab walls are poured utilizing concrete forms defining a wall between six and ten inches in thickness; a typical thickness for a residential basement wall being eight inches. Typically, such walls have a ground material retaining side, the ground material retaining side having a water proofing coating applied thereto.

Upon construction of, for example, a poured concrete basement wall, ground material is back filled to ground level around the outer periphery of the basement causing the dirt to "lying???? directly against the ground material retaining side of the wall. Under normal circumstances loading forces associated with such ground material fill are directed downwardly, applying insignificant horizontal pressure upon the basement wall. However, on occasion, ground material filled against the ground material retaining side of a basement wall will creep or shift horizontally. Where horizontal movement of ground material occurs in the vicinity of a basement or terracing wall extreme pressures in the horizontal direction may be imposed upon the wall, causing the wall to tilt in the direction of the pressure. Where the upper edges of a basement concrete wall serve as a footing for above ground structural walls of a building, even slight tilting of the basement walls may cause severe structural damage.

A known method for straightening a tilted poured concrete basement wall comprises steps of drilling an aperture completely through the basement wall; driving by means of jack hammer a spirally threaded shaft through the aperture to extend eight to ten feet beyond the basement wall into the ground, leaving a spirally threaded end of the shaft extending into the basement; mounting a drawing plate and a spirally threaded nut over said spirally threaded end; excavating a pit in the ground material to expose the opposite end of the threaded shaft; attaching a ground anchor or a deadman to said opposite end; and progressively tightening the threaded nut, pulling the drawing plate and the basement wall outwardly along the shaft. A drawback or deficiency of such known method is that the deadman or anchor must be positioned relatively close to the basement wall due to difficulties in driving steel shafts an extended distance through ground material. Where a basement wall tilts due to horizontal ground pressure, it is often undesirable to place an anchor or deadman in close proximity with the wall, since the same forces which press inwardly upon the basement wall may simultaneously act upon the anchor. Thus, it is desirable to position the anchor an extended distance from the wall. Another drawback or deficiency of the above described known method is that drilling a shaft receiving aperture through the basement wall allows water seepage into the interior spaces of the basement. Another drawback or deficiency of the above described method is that an unsightly nut and drawing plate is necessarily exposed within and operated from the interior spaces of the basement.

The instant inventive assembly and method solves all of the above defects and deficiencies by providing a flexible cable spanning between an exterior surface of a basement wall and an anchor or deadman, and by providing a jackscrew pulling mechanism operable from ground level for pulling the cable and drawing the basement wall toward the ground anchor.

BRIEF SUMMARY OF THE INVENTION

In the instant inventive assembly and method, a basement wall attachment bracket is fixedly attached to the ground retaining side of a basement wall, such wall being in need of straightening; the basement wall attachment bracket having fixedly welded thereto an arcuately curved cable guide and a jackscrew supporting frame; the jackscrew supporting frame being positioned to overlie the arcuately curved cable guide. The jackscrew supporting frame preferably supports a vertically oriented jackscrew. The jackscrew having a lower end adapted for applying a pulling force to a flexible cable. An end of the flexible cable is preferably fixedly attached to the lower end of the jackscrew; the flexible cable is then extended downwardly, and then extended outwardly through the ground material, the cable pressing against and being turned to a substantially horizontal path by the arcuately curved cable guide. Preferably, the cable extends outwardly through the ground material to a point of fixed attachment with a cable anchor buried within the ground. Also preferably, the cable anchor is located sufficiently far from the basement wall to avoid earth shifting movements associated with undesirable basement wall movement.

Preferably, an access channel is provided at the basement wall, the channel extending from the ground surface to the jackscrew, the jackscrew preferably being operable by means of manual rotation of an elongated nut driving socket extending through the access channel from the ground surface to the jackscrew.

In operation of the above described assembly, the jackscrew is actuated by means of a torque wrench applied to the nut driving socket; the drive socket turning a spirally threaded nut, which raises a spirally threaded shaft to provide a pulling force upon the cable. Such pulling force draws the cable over the arcuately curved cable guide, thereby pulling the basement wall toward the cable anchor.

In a suitable alternate configuration, the jackscrew pulling mechanism is mounted upon the cable anchor rather than at the basement wall.

Through use of the above described inventive assembly and method, the cable anchor may be located an extended distance away from the basement wall, avoiding exposure of the cable anchor to the same ground shifting forces which cause undesirable basement wall tilt. Also, through use of the above described assembly and method, all mechanical elements are located outside of the basement wall, avoiding undesired perforation of the basement wall, and avoiding unsightly and inconvenient location of mechanical elements within working and living spaces within the basement wall. The instant inventive assembly and method is equally applicable to poured concrete earth terracing walls.

Accordingly, it is an object of the present invention to provide an assembly and method for straightening a poured concrete basement wall, or earth terracing wall, which allows an anchor or dead man to be located within ground material an extended distance away from the wall.

It is a further object of the present invention to provide such an assembly and method which eliminates any need for perforation of the wall.

It is a further object of the present invention to provide such an assembly and method wherein all mechanical elements thereof are located on the ground material retaining side of the wall.

Other and further objects, benefits, and advantages of the present inventive assembly and method will become known to those skilled in the art upon review of the Detailed Description which follows, and upon review of the appended drawings.

DETAILED DESCRIPTION OF THE PREFERRED EMBODIMENT

Figure 1:
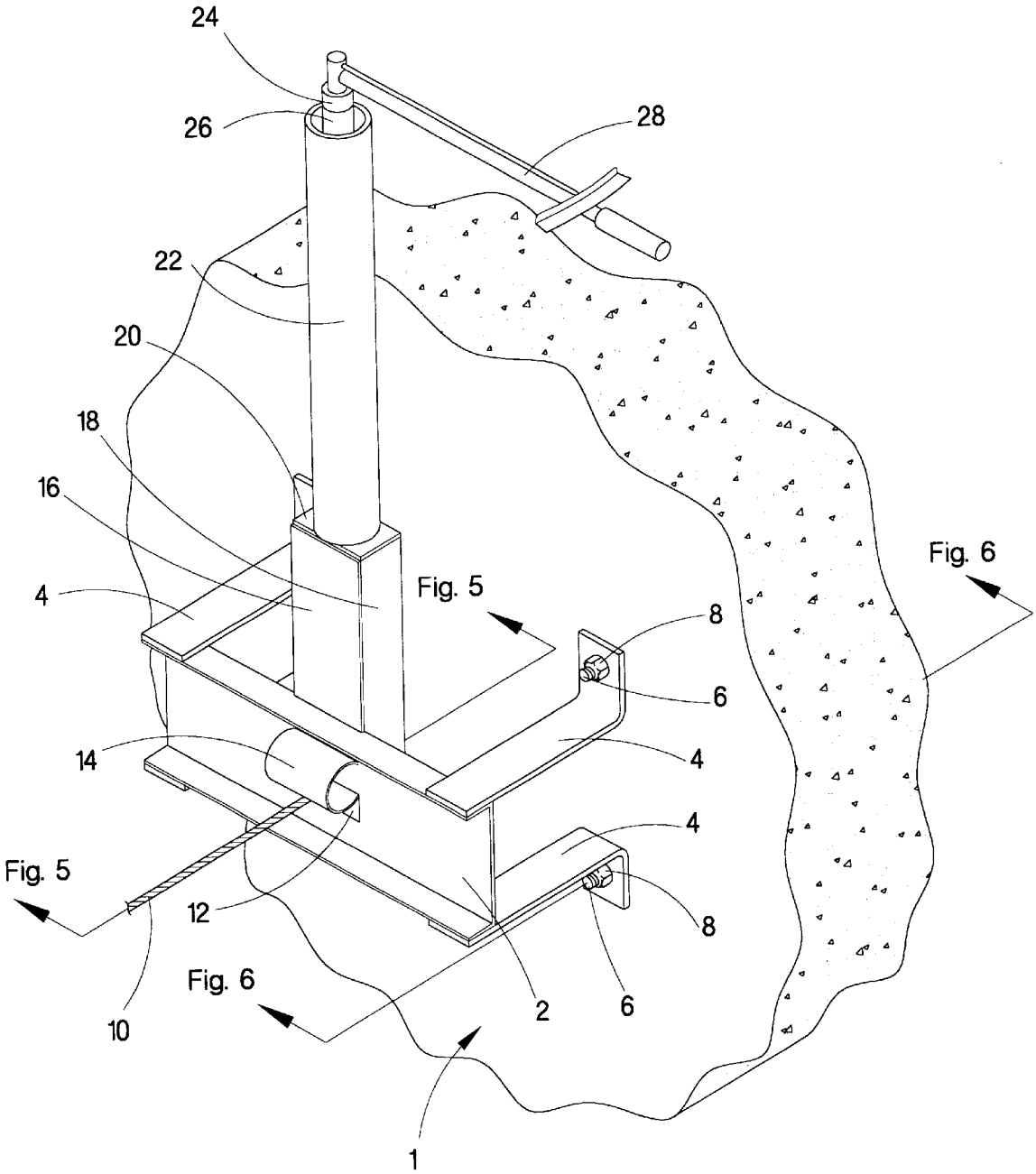
FIG. 1 is an isometric view of a first end of the present inventive assembly.

Referring now to the drawings, and in particular to FIG. 1, reference numeral 1 refers generally to a poured concrete wall in need of straightening. The poured concrete wall 1 may be either a ground material terracing wall or the basement wall of a building. The side of the wall 1 facing the viewer in FIG. 1 is a ground material retaining side; the opposite side of said wall 1 defining the living or working space of a building, or representing the open side of a ground retaining terrace. Typically, where such wall 1 is a poured concrete residential basement wall, the thickness of the wall is approximately eight inches. A common height of such a residential basement wall 1 is nine feet.

Figure 6:
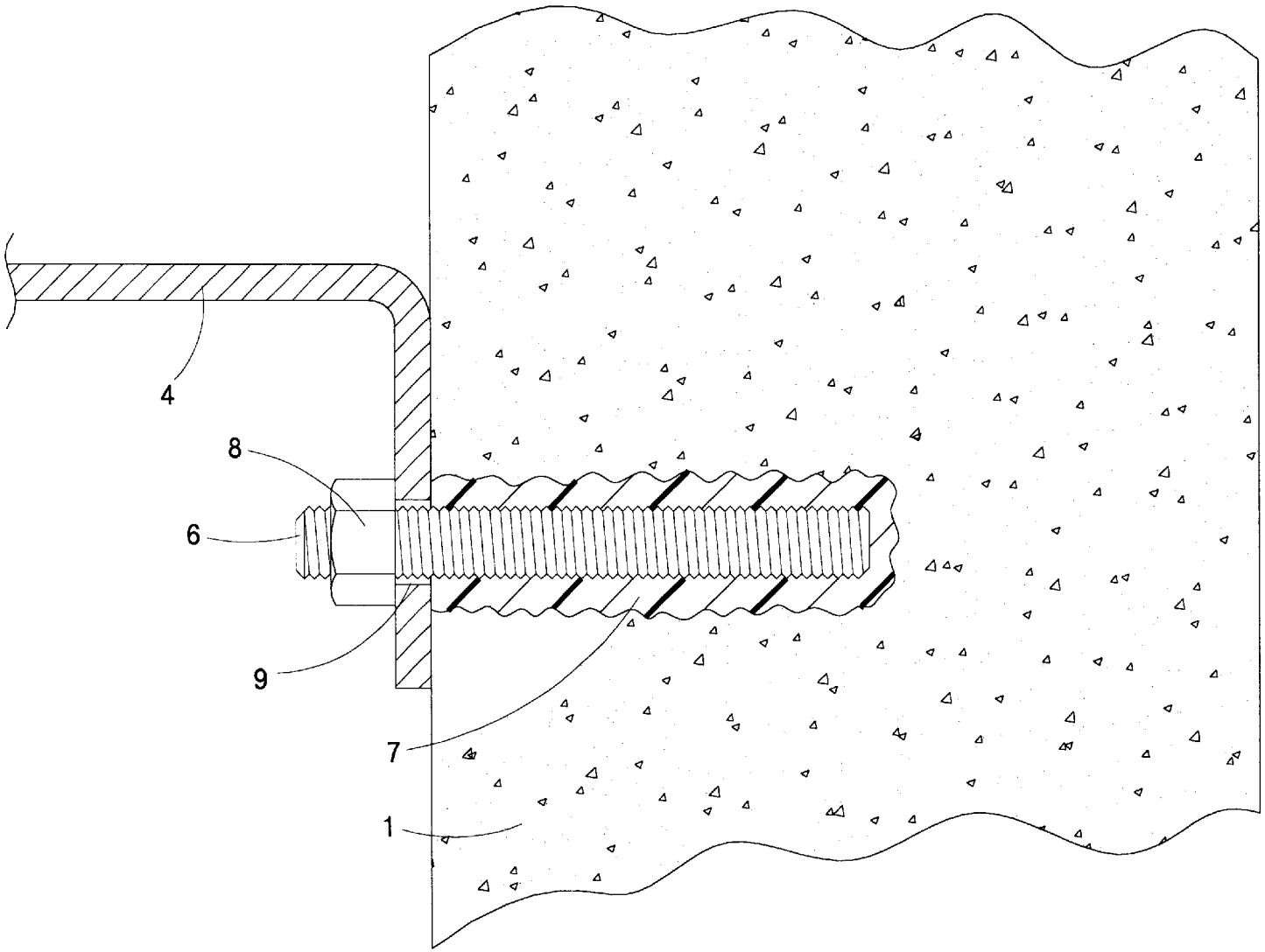
FIG. 6 is a sectional view as indicated in FIG. 1.

Referring further to FIG. 1, an attachment bracket comprising a steel C-channel beam 2, and comprising four steel legs 4 fixedly welded to the C-channel beam 2, is fixedly attached to the ground retaining side of the basement wall 1. Referring simultaneously to FIGS. 1 and 6, a spirally threaded steel shafts 6 extend through shaft receiving apertures 9 within the feet of the legs 4. Each spirally threaded shaft 6 preferably extends into and is fixedly mounted within an epoxy filled cavity 7. By mounting the spirally threaded shafts 6 within epoxy filled cavities 7, such shafts are securely affixed to the wall 1 without the extension of a shaft receiving channel entirely through the wall 1; thus, preserving the integrity of the wall 1. The foot of each leg 4 is preferably securely mounted over the outwardly protruding ends of the spirally threaded shafts 6 by means of spirally threaded nuts 8.

Referring again to FIG. 1, the bracket comprising the C-channel beam 2 and legs 4 preferably is mounted upon the wall 1 in need of straightening approximately three feet below the wall's upper edge.

Figure 5:
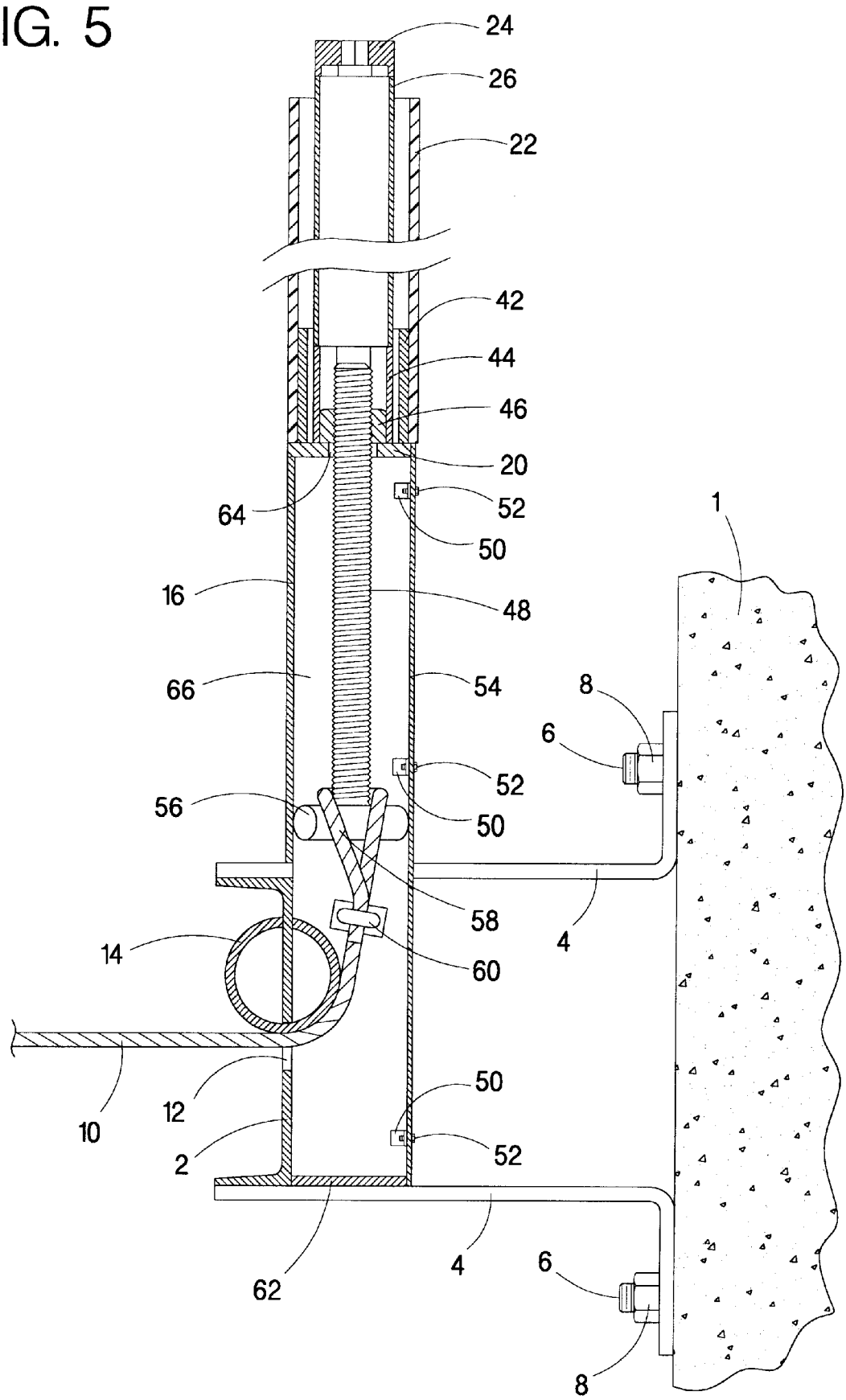
FIG. 5 is a sectional view of the first end of the present inventive assembly.

Referring simultaneously to FIGS. 1 and 5, a jackscrew supporting frame comprising a forward plate 16, a pair of opposing side plates 18, an upper plate 20, and a lower plate 62 are fixedly welded to each other, and to the C-channel beam 2 to form a rigid rearwardly opening box. Preferably, the upper plate 20 has a circular aperture 64 therethrough through which a spirally threaded shaft 48 extends. The spirally threaded shaft 48 further extends through a spirally threaded nut 46. Said jackscrew supporting frame, comprising plate elements 16, 18, 20 and 62, in combination with the nut 46, and in combination with the spirally threaded shaft 48 comprises a jackscrew pulling means. In operation of said jackscrew pulling means, alternate rotation and counter-rotation of the nut 46 about a vertical axis alternately raises and lowers the spirally threaded shaft 48 through the aperture 64 within upper plate 20. While such rotation occurs, a T-bar 56 fixedly welded to the lower end of the spirally threaded shaft 48 biases against the inwardly facing walls of the frame, preventing rotation of the spirally threaded shaft 48.

The jackscrew pulling means depicted in FIG. 5 may be alternately configured to include a rotatable and vertically positionable spirally threaded shaft which travels through a fixed nut. Such configuration is not preferred because it requires a swivel at the cable pulling juncture.

The jackscrew pulling means depicted in FIG. 5 may also be alternately configured to include a vertically fixed and rotatable spirally threaded shaft having a cable pulling nut spirally threadedly mounted over its lower end. However, such configuration is not preferred to difficulties in mounting cable attaching means upon such a spirally threaded nut.

Other alternate configurations of the jackscrew pulling means depicted in FIG. 5 are possible but are not desirable due to complexity of structure.

Referring further to FIGS. 1 and 5, the bracket comprising the C-channel beam 2 and legs 4 serves dual functions of supporting the jackscrew pulling means and supporting an arcuately curved cable guide. As depicted in FIGS. 1 and 5, the arcuately curved cable guide is preferably configured as a cylindrical pipe section 14 which is longitudinally slotted, such slot allowing the cylindrical pipe section to be extended through a rectangular cable aperture 12, and fixedly welded to the web of the C-channel beam 2. Numerous other configurations of an arcuately curved cable guide may be utilized, such as a rotatably mounted wheel. Also suitably, material of the web of the C-channel beam may be cut and bent to simultaneously form the arcuately curved cable guide and the aperture 12.

Referring further to FIGS. 1 and 5, a first section of a spirally wound steel cable 10 extends along a substantially horizontal path toward the C-channel beam 2 to underlie the arcuately curved cable guide 14, thence extending through aperture 12. A second contiguous section of the flexible cable 10 then extends upwardly at an angle with respect to the path of the first section, such second section extending within the interior space 66 of the jackscrew support frame. The arcuately curved cable guide 14 serves as the vertex of the angle between the first and second sections of the cable 10, redirecting pulling forces applied to the second section of the cable 10. The end of the second section of the cable 10 preferably is formed into a loop 58, the loop being held by a cable clamp 60; the loop 58 being securely mounted over the T-bar 56 fixedly welded to the threaded shaft 48.

Referring to FIG. 5, upon placement of the loop 58 of the cable 10 over the T-bar 56, the interior space 66 is preferably packed with axle grease. Preferably, a dirt shield 54 is then mounted upon the frame to cover its rearward opening by means of screws 52 which extend into screw receiving tabs 50. The dirt shield 54 prevents dirt and debris from entering the interior space 66, preventing fouling of the jackscrew mechanism.

Referring simultaneously to FIGS. 1 and 5, a cylindrical upwardly opening collar 42 is preferably fixedly welded to the upper surface of upper plate 20. A pipe 22, preferably comprising polyvinyl chloride plastic, is preferably slidably mounted over the collar 42, and is adhesively attached thereto. Preferably, the pipe 22 extends through the ground material upwardly to a point above the ground surface; the bone of the pipe 22 defining an access channel extending from the ground surface downward to the spirally threaded nut 46. Typically, the pipe 22 will be approximately three feet in length with six to ten inches of its length extending above the ground surface.

Referring to further to FIGS. 1 and 5, a preferred means of operating the jackscrew from the ground surface utilizes a common socket driver cut into an upper piece 24 and a lower piece 44, the upper piece 24 of the socket driver being fixedly welded to an upper end of a steel pipe 26, and the lower piece 44 of the socket driver being fixedly welded to the lower end of the pipe 26. Such a welded combination of an upper piece 24 of a socket driver, a steel pipe 26, and the lower piece 44 of the socket driver constitutes an extended socket driver; the extension allowing a torque wrench 28 to be utilized for driving the nut 46 of the jackscrew pulling means. After utilization of the extended socket driver comprising elements 24, 26, and 44, such socket driver is preferably withdrawn, and a cap is slidably mounted over the upper end of the pipe 22, preventing moisture and debris from entering the access channel and fouling the operation of the nut 46.

Figure 4:
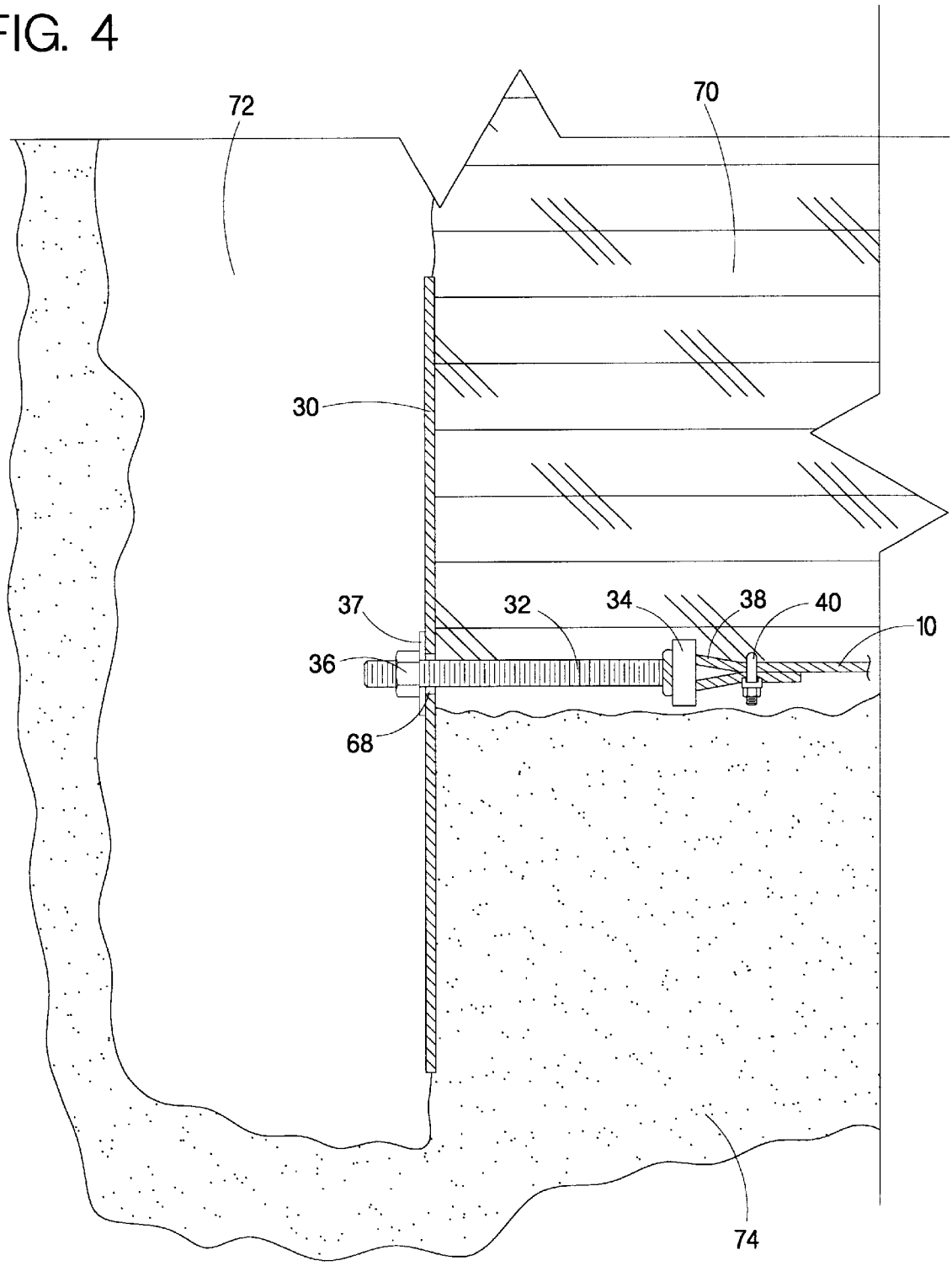
FIG. 4 is a ground section view of the second end of the present inventive assembly.

Referring simultaneously to FIGS. 1 and 4, a cable anchor installation pit 72 is preferably dug into the ground 74 within a zone of stable soil, typically twenty to thirty feet perpendicularly outward from the wall 1. A narrow trench 70 is then excavated, the trench 70 extending from the pit 72 to a second pit (not depicted) in which the cable pulling mechanism is situated. A cable anchor 30, preferably comprising a rectangular steel plate having an aperture 68 therethrough is preferably positioned against the wall of the pit 72 nearest the basement wall 1, and a second spirally threaded shaft 32 having a T-head 34 is extended through the aperture 68, through a washer 37, and through a spirally threaded nut 36. The end of the first section of the steel cable 10 preferably forms a loop 38 held by a cable clamp 40, the loop 38 engaging the T-head 34. In operation, the spirally threaded nut 36 is rotated about the spirally threaded shaft 32 to provide the initial tension to the steel cable 10. While utilization of a rectangular cable anchor 30 or deadman is preferable, other cable anchors such as a buried wooded beam, or a buried concrete block may be utilized.

As an alternative to placement of the steel cable 10 along an excavated trench 70, such cable 10 may be drawn through the ground material through the operation of a cable drawing vibrating plow.

Figure 2:
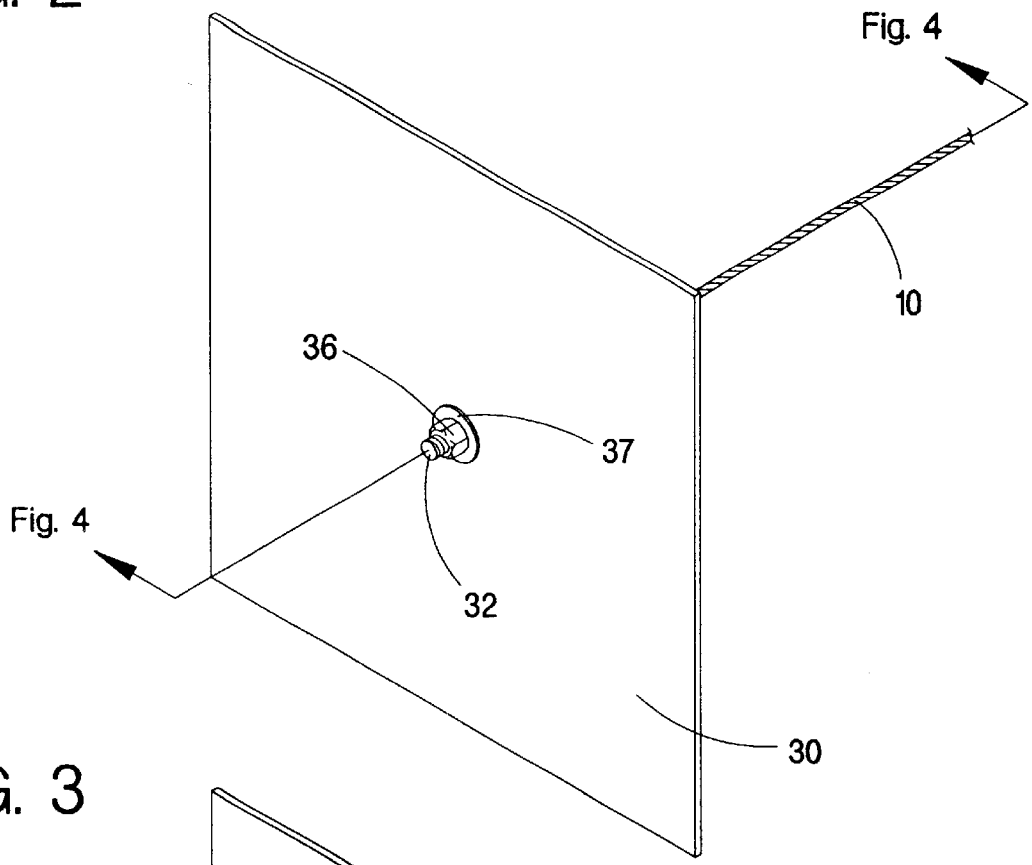
FIG. 2 is an isometric view of a second end of the present inventive assembly.
Figure 3:
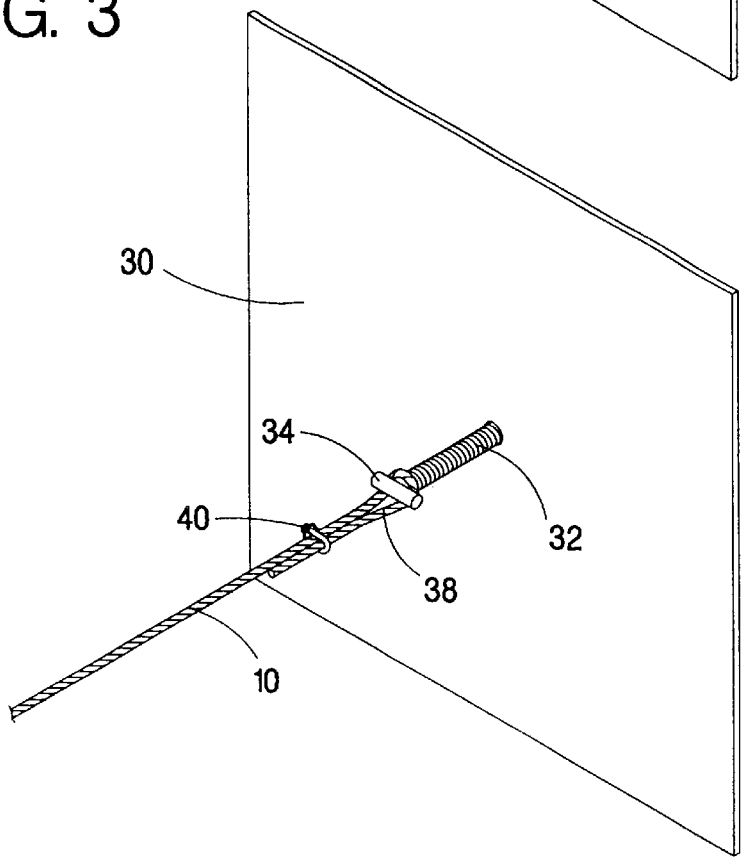
FIG. 3 is an opposite view of the assembly depicted in FIG. 2.
Figure 7:
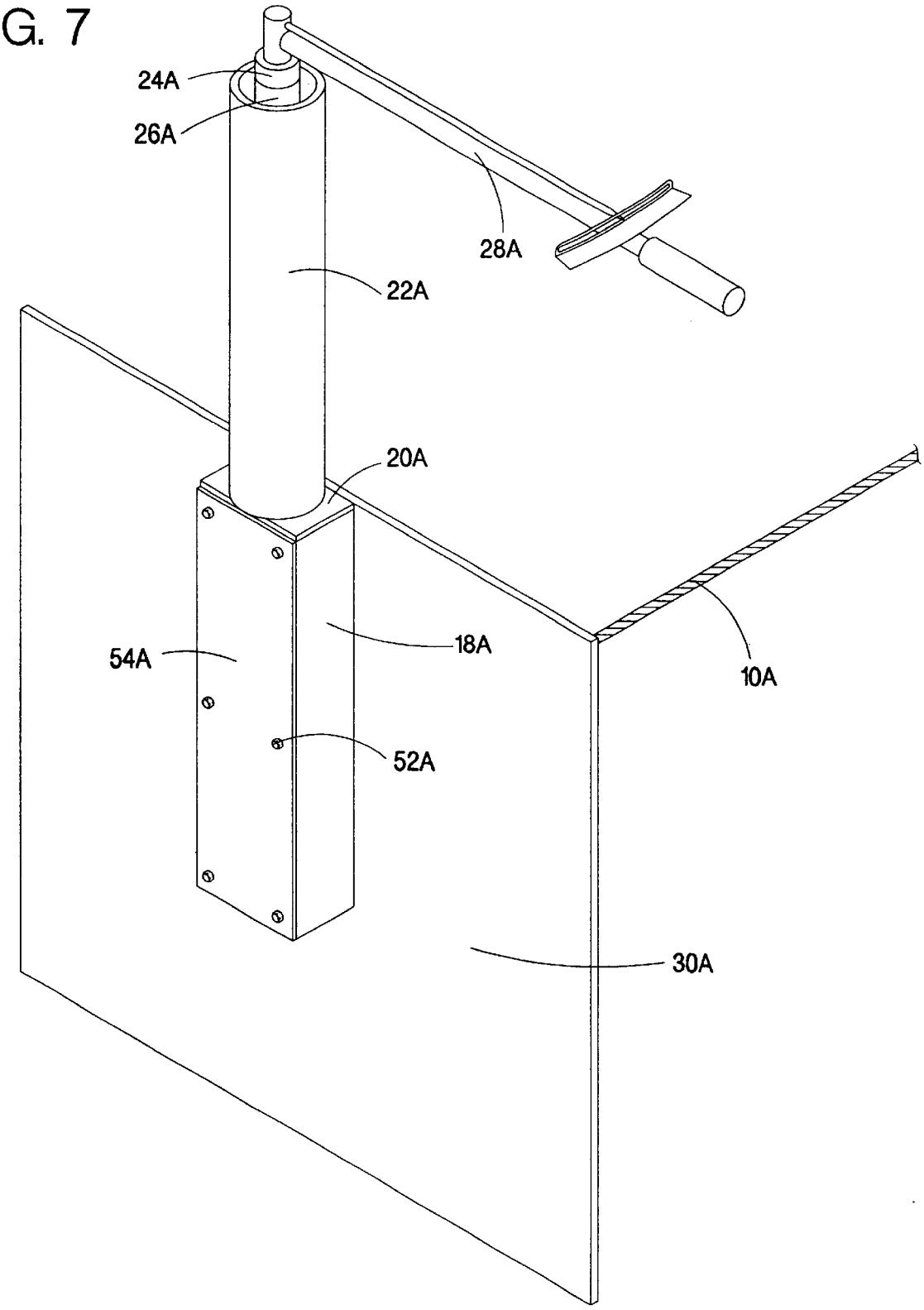
FIG. 7 is an alternate configuration of FIG. 2.

Referring to the alternate configuration depicted in FIG. 7, all reference numerals bearing the suffix "A" are substantially the same as similarly numbered elements appearing in other figures. As depicted in FIG. 7, the cable pulling mechanism is alternately fixedly mounted upon the cable anchor 30A, while the opposite end of the cable is mounted on, referring to FIG. 1, the web of a C-channel 2 in a manner similar to the cable mount depicted in FIGS. 2 and 3.

In operation of the present inventive assembly and method, referring simultaneously to FIGS. 1, 4, and 5, spirally threaded shaft 32 and spirally threaded shaft 48 are preferably extended as depicted; and loops 38 and 58 of the steel cable 10 are preferably adjusted so that the steel cable 10 spans between T-bars 34 and 56. The loops 56 and 38 are then fixedly clamped by cable clamps 60 and 40. Upon such installation of the steel cable 10, a torque wrench 28 is utilized to tighten spirally threaded nut 36 to approximately ninety foot pounds of torque. Upon such tightening, pit 72 and trench 70 are filled. Similarly, the cable pulling mechanism pit is filled, leaving approximately eight inches of the upper end of pipe 22 exposed above the ground surface.

On an approximately weekly basis, the cap [not depicted] covering the upper end of the pipe 22 is removed, the extended socket is downwardly extended through the bore of the pipe 22 to engage the nut 46. The torque wrench 28 is then utilized to tighten the nut 46 in a clockwise direction to approximately ninety foot pounds of torque.

During time periods when the ground 72 in contact with the ground retaining side of the wall 1 is saturated with water, only a small amount of rotation of the nut 46 will result in ninety foot pounds of turning resistance. However, during periods of dry ground conditions, several rotations of the nut 46 may be achieved prior to reaching ninety foot pounds of resistance. It is during such periods of dry ground conditions when the process of straightening the wall 1 progresses most quickly. Through utilization of the present inventive assembly and method for straightening a ground retaining wall, such wall may be progressively straightened over a period of several weeks.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for straightening a wall, the assembly comprising:

(a) a cable anchor;

(b) a flexible cable comprising a first section and a second section, the second section being contiguous with the first section, the first section extending along a path toward the cable anchor, the second section extending upwardly at an angle away from the path of the first section;

(c) means for applying a pulling force to said second section;

(d) means for interconnecting the second section of the flexible cable and the means for applying a pulling force; and, (e) means for transmitting the pulling force to the wall at the angled intersection of said first and second sections.

2. The assembly of claim 1 wherein the pulling force transmitting means comprises an arcuately curved cable guide positioned in contact with the flexible cable between said first and second sections, and further comprises means for interconnecting the arcuately curved cable guide and the wall, and further comprises means for interconnecting the first section of the flexible cable and the cable anchor.

3. The assembly of claim 2 wherein the means for interconnecting the cable guide comprises a bracket extending from the arcuately curved cable guide.

4. The assembly of claim 3 wherein the means for interconnecting the first section of the cable and the cable anchor comprises a cable drawing screw extending from the cable anchor to the first section of the flexible cable.

5. The assembly of claim 4 wherein the means for applying a pulling force comprises a frame fixedly attached to and extending upwardly from the arcuately curved cable guide, and further comprises a jackscrew, the jackscrew being supported by the frame, the jackscrew having a spirally threaded shaft positioned in alignment with the second section of the flexible cable.

6. The assembly of claim 5 wherein the jackscrew has a rotatable spirally threaded nut, the jackscrew being operable to apply the pulling force to the second section of the flexible cable through rotation of said nut.

7. The assembly of claim 1 wherein the pulling force transmitting means comprises an arcuately curved cable guide positioned in contact with the flexible cable between said first and second sections, and further comprises means for interconnecting the arcuately curved cable guide and the cable anchor, and further comprises means for interconnecting the first section of the flexible cable and the wall.

8. The assembly of claim 7 wherein the means for interconnecting the first section of the cable and the wall comprises a bracket and a cable drawing screw, the cable drawing screw interconnecting the bracket and the first section of the flexible cable.

9. The assembly of claim 8 wherein the means for applying a pulling force comprises a frame fixedly attached to and extending upwardly from the arcuately curved cable guide, and further comprises a jackscrew, the jackscrew being supported by the frame, the jackscrew having a spirally threaded shaft positioned in alignment with the second section of the flexible cable.

10. The assembly of claim 9 wherein the jackscrew has a rotatable spirally threaded nut, the jackscrew being operable to apply the pulling force to the second section of the flexible cable through rotation of said nut.

11. A method for straightening a wall, the wall having a ground retaining side, the ground retaining side of the wall retaining ground material, the ground material having a ground surface, the method comprising the steps of:

(a) attaching a pulling mechanism to the ground retaining side of the wall; the pulling mechanism comprising a jackscrew and an arcuately curved cable guide;

(b) attaching a first end of a flexible cable to the jackscrew;

(c) extending the flexible cable over the arcuately curved cable guide;

(d) further extending the flexible cable through the ground material;

(e) attaching a second end of the flexible cable to a cable anchor buried within the ground material;

(f) operating the pulling mechanism to draw the flexible cable over the arcuately curved cable guide, pulling the wall toward the cable anchor.

12. The method of claim 11 wherein the step of attaching the pulling mechanism comprises boring anchor shaft receiving holes within the wall, fixedly mounting threaded anchor shafts within the anchor shaft receiving holes, and fixedly mounting a jackscrew supporting frame upon the threaded anchor shafts.

13. The method of claim 11 wherein the step of attaching the first end of the flexible cable to the jackscrew comprises forming said first end into a loop, and engaging said loop with the jackscrew.

14. The method of claim 11 wherein the step of extending the flexible cable through the ground material comprises one of laying the flexible cable within an excavated trench formed within the ground material and operating a vibrating plow to draw the flexible cable through the ground material.

15. The method of claim 11 wherein the step of operating the pulling mechanism to draw the flexible cable comprises of providing an access channel extending from the ground surface to the pulling mechanism, extending a nut driving socket through said channel, engaging a lower end of the nut driving socket with the jackscrew and applying rotational torque to the nut driving socket.

16. The method of claim 11 wherein the step of attaching the second end of the flexible cable to the cable anchor comprises mounting a spirally threaded cable drawing shaft upon the cable anchor, forming the second end of the flexible cable into a loop, and engaging said loop with the spirally threaded cable drawing shaft.

17. A method for straightening a wall, the wall having a ground retaining side, the ground retaining side of the wall retaining ground material, the ground material having a ground surface, the method comprising the steps of:

(a) burying a cable anchor within the ground material, the cable anchor having a pulling mechanism fixedly attached thereto, the pulling mechanism comprising a jackscrew and an arcuately curved cable guide;

(b) attaching a first end of a flexible cable to the jackscrew;

(c) extending the flexible cable over the arcuately curved cable guide;

(d) further extending the flexible cable through the ground material;

(e) attaching a second end of the flexible cable to the wall;

(f) operating the pulling mechanism to draw the flexible cable over the arcuately curved cable guide, pulling the wall toward the cable anchor.

18. The method of claim 17 wherein the step of attaching the first end of the flexible cable to the jackscrew comprises of forming said first end into a loop, and engaging said loop with the jackscrew.

19. The method of claim 17 wherein the step of extending the flexible cable through the ground material comprises one of laying the flexible cable within an excavated trench formed within the ground material and operating a vibrating plow to draw the flexible cable through the ground material.

20. The method of claim 17 wherein the step of operating the pulling mechanism to draw the flexible cable comprises providing an access channel extending from the ground surface to the pulling mechanism, extending a nut driving socket through said channel, engaging a lower end of the nut driving socket with the jackscrew, and applying rotational torque to the nut driving socket.

21. The method of claim 17 wherein the step of attaching the second end of the flexible cable to the wall comprises fixedly attaching a bracket to the wall, mounting a spirally threaded cable drawing shaft upon the bracket, forming the second end of the flexible cable into a loop, and engaging said loop with the spirally threaded cable drawing shaft.

* * * * *